United States Patent [19]

Kanaya

[11] Patent Number: 4,976,421

[45] Date of Patent: Dec. 11, 1990

[54] PAPER FEED CONTROL DEVICE FOR COPIER WHICH DETERMINES THE ACTUAL NUMBER OF SHEETS REMAINING

[75] Inventor: Koichi Kanaya, Tokyo, Japan

[73] Assignee: Ricoh Company, Ltd., Tokyo, Japan

[21] Appl. No.: 415,476

[22] Filed: Oct. 2, 1989

Related U.S. Application Data

[60] Continuation of Ser. No. 174,373, Mar. 28, 1988, abandoned, which is a division of Ser. No. 870,525, Jun. 4, 1986, abandoned.

[30] Foreign Application Priority Data

Jun. 4, 1985 [JP] Japan ..... 60-119754
Jun. 14, 1985 [JP] Japan ..... 60-128060

[51] Int. Cl.[5] ..... B65H 7/14

[52] U.S. Cl. ..... 271/258; 271/155; 271/259; 271/157

[58] Field of Search ..... 271/25, 31, 38, 110, 271/111, 130, 117, 126, 127, 147, 136, 162, 152, 153, 154, 155, 157, 258, 259, 265; 377/6, 8, 49

[56] References Cited

U.S. PATENT DOCUMENTS 4,535,463 8/1985 Ito et al. ..... 271/155 X

FOREIGN PATENT DOCUMENTS 0113160 9/1979 Japan ..... 271/155
0022235 2/1983 Japan ..... 271/155
0063636 4/1983 Japan ..... 271/162
0063637 4/1983 Japan ..... 271/258
0031234 2/1984 Japan ..... 271/258
0230934 12/1984 Japan ..... 271/258

*Primary Examiner*—H. Grant Skaggs
*Attorney, Agent, or Firm*—Oblon, Spivak, McClelland, Maier & Neustadt

[57] ABSTRACT

A paper feed control device for controlling a paper feed level, or height, to a predetermined level by moving up and down a tray which is loaded with a stack of papers by a motor. A proportional relation between the number of paper fed as counted by a paper counter and the number of encoder pulses which is associated with an amount of movement of the tray is calculated to determine how many pulse will appear before a near-paper-end condition is reached. Based on a result of the decision, the paper feed is controlled.

1 Claim, 7 Drawing Sheets

| $V_{CC}$ | $\overline{E}$ | $\overline{G}$ | $\overline{W}$ | MODE | DO | POWER |
|---|---|---|---|---|---|---|
| ≥ 5.5 VOLTS | H | x | x | DESELECT | HIGH Z | STANDBY |
| | L | x | L | WRITE | $D_{IN}$ | ACTIVE |
| ≥ 4.75 VOLTS | L | L | H | READ | $D_{OUT}$ | ACTIVE |
| | L | H | H | READ | HIGH Z | ACTIVE |
| > 4.5 VOLTS | x | x | x | WRITE PROTECT | HIGH | ZERO |

*FIG. 7*

PAPER FEED CONTROL DEVICE FOR COPIER WHICH DETERMINES THE ACTUAL NUMBER OF SHEETS REMAINING

This application is a continuation of application Ser. No. 07/174,373, filed on Mar. 28, 1988, now abandoned which is a Division of application Ser. No. 870,525, filed on Jun. 4, 1986, now abandoned

BACKGROUND OF THE INVENTION

The present invention relates to a paper feed control device which is installed in a copier for controlling a paper feed level to a predetermined one by moving up and down a tray which is loaded with a stack of papers by means of a motor or the like.

In a high-speed copier, it sometimes happens that before a document is fed by an RDF (recirculation document feeder) or an ADF (automatic document feeder) to a predetermined copying station, several papers have been fed from a paper feeding device. Paper end, therefore, needs to be detected before the tray is emptied, i.e., while several papers are still left in the tray.

It has been customary to estimate a remaining amount of papers based on a level, or height, of the tray. Specifically, when the tray has been raised beyond a certain reference level, it is determined that a paper-end or a near-paper-end condition is reached in order to avoid an occurrence that papers are used up during the course of copying cycles. Usually, a level of the tray is determined by counting up pulses which an encoder mounted in the paper feeding device generates during upward and downward movements of the tray. Meanwhile, various kinds of papers are used with a copier and they differ in thickness, for example. It follows that for the same number encoder output pulses a comparitively large number of papers may have been left if the paper thickness is small and a comparatively small number of papers if otherwise. In this manner, the prior art system for sensing a remaining amount of papers lacks in reliability.

SUMMARY OF THE INVENTION

It is therefore an object of the present invention to provide a paper feed control device for a copier which is capable of accurately sensing a remaining amount of papers before a copying operation with no regard to the kind of papers used.

It is another object of the present invention to provide a paper feed control device for a copier which is capable of reducing the frequency of paper supply as far as possible by accurately sensing near-paper-end with no regard to the kind of papers used.

It is another object of the present invention to provide a generally improved paper feed control device for a copier.

In one aspect of the present invention, there is provided a paper feed control device for controlling a paper feed level, or height, to a predetermined one by moving up and down a tray which is loaded with a stack of papers by a motor or the like. The device comprises an encoder for generating pulses responsive to an amount of movement of the tray during each of upward and downward movements of the tray, a counter for counting papers which are sequentially fed from the tray, a decision circuit for calculating a relation between a number of papers fed from the tray and pulses generated by the encoder and determining a number of pulses which are to appear before near-paper-end, a first store for storing the number of papers fed, the number of pulses generated by the encoder and other data, and a second store storing a program for interrupting paper feed based on an output of the decision circuit.

In another aspect of the present invention, there is provided a paper feed control device for controlling a paper feed level, or height, to a predetermined by moving up and down a tray which is loaded with a stack of papers by a motor or the like. The device comprises an encoder for generating pulses responsive to a particular amount of movement of the tray during each of upward and downward movement of the tray, a paper counter for counting papers which are sequentially fed from the tray, a pulse counter for determining how many pulses have been generated for the feed of a predetermined number of papers, a calculating circuit for calculating how many papers are necessary to complete a particular copy mode which is selected by an operator, a first store for storing the number of papers fed, the number of pulses and other data, and a second store storing a program for controlling the above-stated means.

The above and other objects, features and advantages of the present invention will become more apparent from the following detailed description taken with the accompanying drawings.

BRIEF DESCRIPTION OF THE DRAWINGS

FIG. 7 shows a truth table associated with the memory;

DESCRIPTION OF THE PREFERRED EMBODIMENTS

While the paper feed control device for a copier of the present invention is susceptible of numerous physical embodiments, depending upon the environment and requirements of use, substantial numbers of the herein shown and described embodiments have been made, tested and used, and all have performed in an eminently satisfactory manner.

Figure 1:
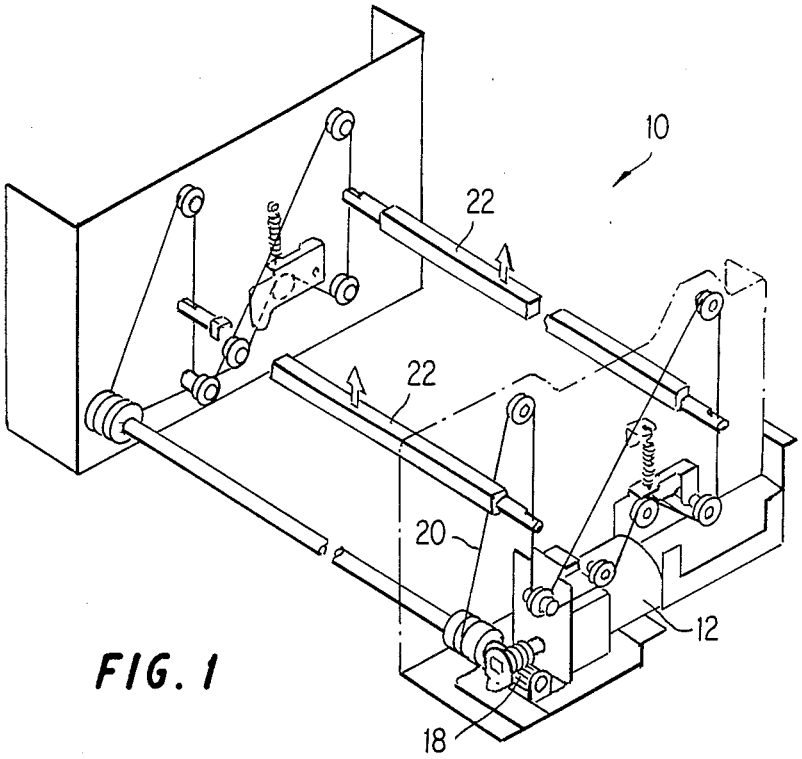
FIG. 1 is a perspective view of a drive mechanism included in a paper feeding apparatus to which the present invention is applicable.
Figure 2:
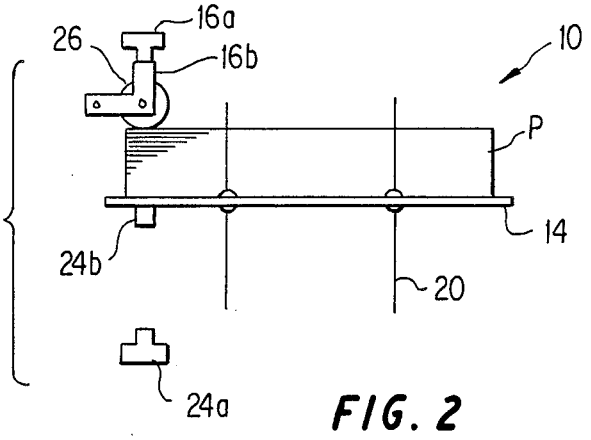
FIG. 2 is a schematic diagram showing a positional relationship between sensors arranged around a tray and a paper feed position associated with the apparatus of FIG. 1.

Referring to FIG. 1 of the drawings, a drive mechanism associated with a paper feeding apparatus to which the present invention is applied is shown. Sensors arranged around a tray and a paper feed level are schematically shown in FIG. 2. The paper feeding apparatus, generally 10, includes a motor 12 adapted to move up and down a tray 14 which is loaded with a stack of papers P. The motor 12 is controlled by a signal which is outputted by a central processing unit (CPU), which will be described. Because papers cannot be fed unless the tray 14 is constantly and fully raised during the course of paper feed, the apparatus 10 is programmed such that every time a screening plate 16b has moved away from a photointerrupter 16a, a raise signal is fed to the motor 12. The rotation of the motor 12 is transmitted by a worm gear 18 and a wire 20 to a pair of tray shafts 22. The tray 14 is fixedly mounted on the tray shafts 22. An output signal of the photointerrupter 16a which cooperates with the plate 16b to sense the rise of the tray 14 to a predetermined paper feed level, or upper limit, is routed to the CPU. A photointerrupter 24a and a screening plate 24b, on the other hand, cooperate to sense the fall of the tray 14 to a predetermined lowermost level, or lower limit. When an output of the photointerrupter, or lower limit sensor, 24a has been fed to the CPU, the rotation of the motor 12 is stopped. Rolls 26 are mounted on the plate 16b and, although not shown in the drawing, driven from another drive source to feed out papers one by one.

Figure 3:
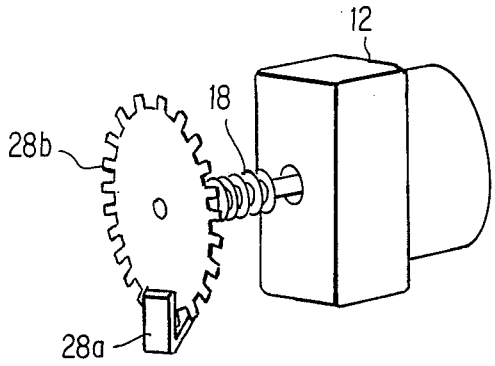
FIG. 3 is a view of an encoder.

Referring to FIG. 3, there is shown how encoder pulses are generated during upward and downward movements of the tray 14 which is driven by the motor 12. Upon rotation of the motor 12, a photointerrupter 28a and a screening plate 28b which constitute an encoder generate pulses with no regard to the direction of rotation and applies the pulses to the CPU.

Figure 4:
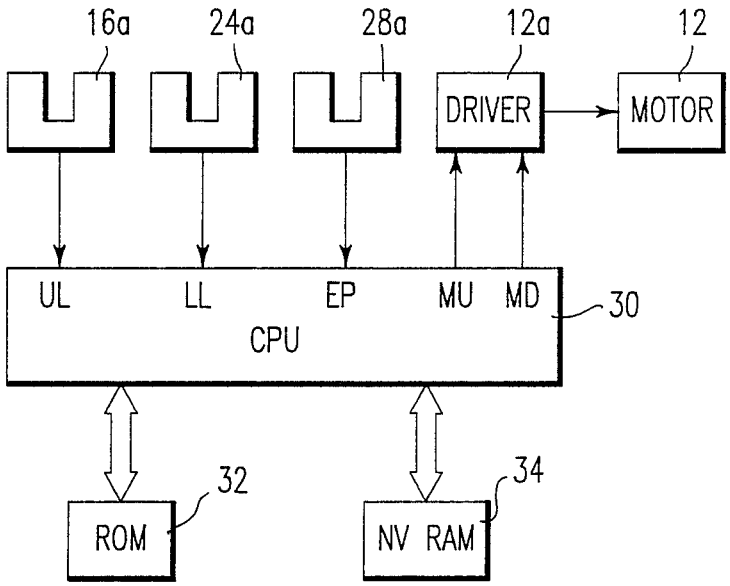
FIG. 4 is a block diagram representative of a paper feed control in accordance with the present invention.

Referring to FIG. 4, a circuit associated with the control of the apparatus 10 is shown in a block diagram. The CPU 30 activates a motor driver 12a responsive to sensor signals which are applied to ports UL, LL and EP thereof and thereby controls the motor 12, performs various mathematical operations, and effects controls according to a predetermined program. A read only memory (ROM) 32 stores programs for controlling the apparatus 10. A non-volatile random access memory (NV-RAM) 34 is allowed to hold data memorized therein even when a power source is turned off by a backup battery which is built therein. As the photointerrupters 16a, 24a and 28a sense their associated screening plates, the ports UL, LL and EP assigned to them, respectively, become logical high level, or a ONE. When a control port MU associated with the motor 12 has been turned to a ONE, the motor 12 is rotated in a direction for raising the tray 14. Conversely, when a control port MD has been turned to a ONE, the motor 12 is rotated in a direction for lowering the tray 12. In this particular arrangement, the NV-RAM 34 is implemented with MK48ZO2 available from MOSTEK. This memory is constructed by loading an ordinary RAM with a lithium battery and in such a manner as to automatically activate a backup battery when sensed cut-off of a main power source.

Figure 5:
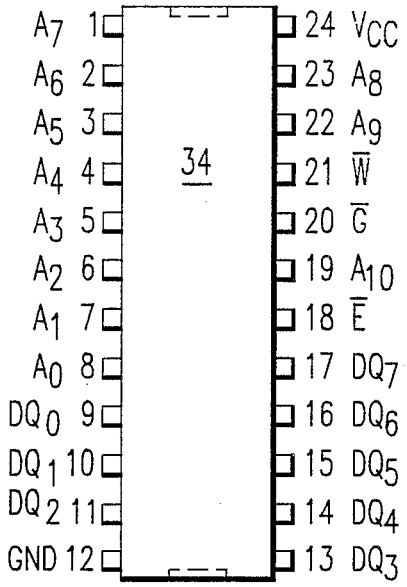
FIG. 5 shows pin positions of a non-volatile random access memory.
Figure 6:
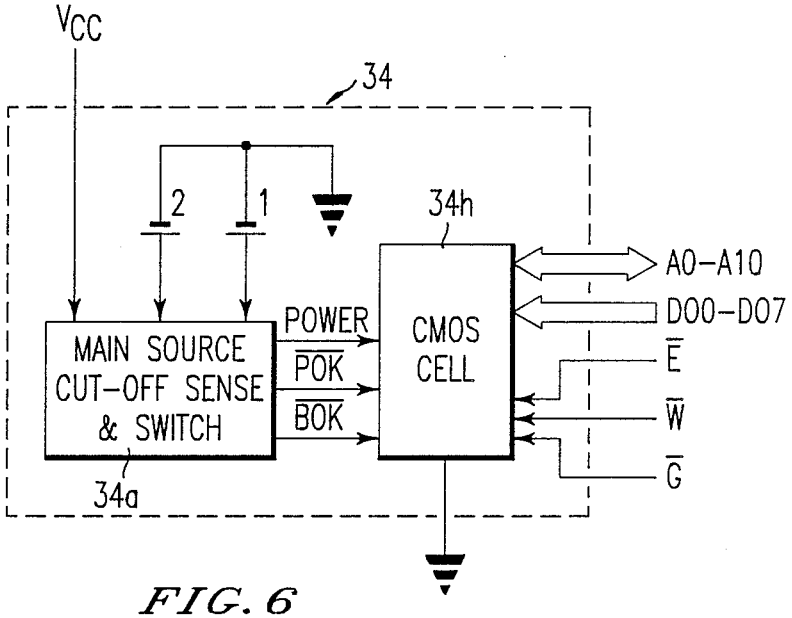
FIG. 6 is a block diagram of the memory.

FIG. 5 shows an arrangement of pins of the NV-RAM 34, FIG. 6 the NV-RAM 34 in a block diagram, and FIG. 7 a truth table. As shown in FIG. 5, the NV-RAM 34 includes pins $A_0$ to $A_{10}$ for address input, a pin E for write enable, a pin G for output enable, and pins $DO_0$ to $DO_7$ for data in/data out.

As shown in FIG. 5, the NV-RAM 34 operates in exactly the same way as an ordinary RAM so long as a main power source is turned on. However, the NV-RAM 34 is equipped with a voltage detection circuit so as to change the behavior depending upon a voltage $V_{CC}$. While the voltage $V_{CC}$ lies within a range of 4.7 volts to 5.50 volts, the NV-RAM 34 allows data to be written thereinto and read thereoutof by operating the pins E, G and W. As the voltage $V_{CC}$ is lowered to a range of 4.50 volts to 4.75 volts, the NV-RAM 34 assumes a write inhibit mode. Further, when the voltage $V_{CC}$ has been lowered to a range of 3.00 volts to 4.50 volts, the data input pins gain a don't-care state while the output pins gain a high impedance. As soon as the voltage $V_{CC}$ is lowered beyond 3.00 volts, the power supply is automatically switched from the main power source to the built-in lithium battery so as to prevent data stored from being lost. At a power buildup stage, a process which is opposite to the above-described is performed. In FIG. 6, the reference numeral 34a designates a main source cut-off sensing and switching circuit, and 34b a CMOS cell.

A basic operation of the apparatus 10 is as follows.

As the power source is turned on, the tray 14 is once lowered to the lower limit. As the lower limit sensor senses the screening plate 24b, the motor 12 is deenergized. At this instant, a counter adapted to count encoder pulses is reset to zero. If papers are present in the tray 14, a raise signal is fed from the CPU 30 to the motor driver 12a to thereby raise the tray 14. The encoder pulses are counted and applied to a pulse counter. When the plate 16b has been forced into the upper limit sensor, the motor 12 is deenergized. The stack of papers on the tray 14 is sequentially reduced after the start of paper feed. When the plate 16b has been moved clear of the upper limit sensor, the motor 12 is rotated again in a direction for raising the tray 14; as soon as the plate 16b enters the upper limit sensor 16a again, the motor 12 is stopped. Such a procedure allows the papers to be constantly held at a predetermined level. At this instant, too, encoder pulses are counted every time the motor 12 is rotated, the pulse counter being sequentially incremented.

So far as an ordinary low-speed copier is concerned, interrupting a copying operation after all the papers have been used up is no problem from a timing standpoint. However when it comes to a high-speed copier, such is undesirable because at the time when one intends to interrupt the operation several documents have already been fed into RDF and latent images and/or developed images have been formed on a photoconductive element. To avoid such an occurrence, in a high-speed copier, a condition wherein the papers have run short is regarded as a near-paper-end condition to interrupt the copying operation. That is, whether the pulse counter which is counting encoder pulses is incremented beyond a certain reference value is checked. Specifically, assume that 1,000 encoder pulses are generated during movement of the tray 14 which is empty from the lower limit to the upper limit. Then, when the pulse counter has been incremented to "950" to "990" during paper feed, it may be determined that the papers have run short. However, even if the pulse counter is incremented to "990", the number of remaining papers obviously depends on the thickness of the papers used. For example, in the case of relatively thin papers such as second originals, fifty of them will correspond to only several ones of relatively thick papers.

In light of the above, in accordance with a first embodiment of the present invention, the number of papers actually fed and the number of encoder pulses generated then are held in mutual correspondence in order to estimate, for a particular kind of papers which are currently stacked on the tray, how many pulses will represent a paper-end condition. Such a control will be described with reference to flowcharts hereinafter.

Figure 8:
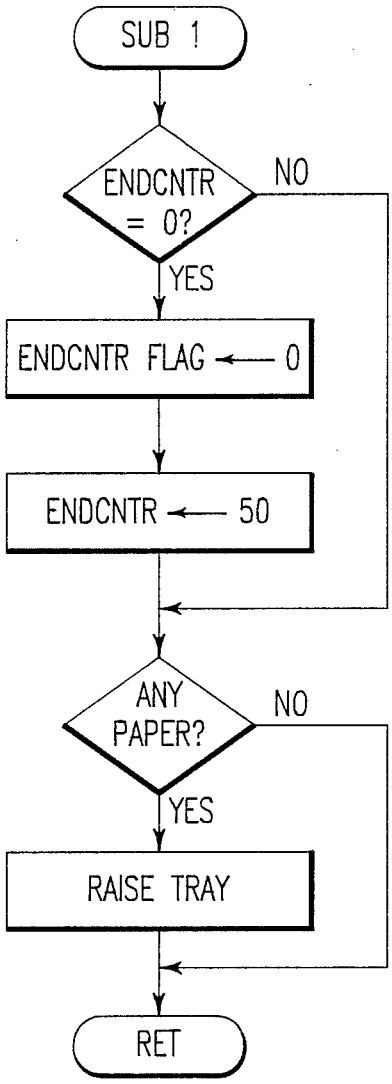
FIGS. 8, 9, 10, 11 and 12 are flowcharts demonstrating a paper feed control procedure in accordance with a first embodiment of the present invention.

Referring to FIG. 8, SUB 1 is representative of a subroutine which is called up at the time of power turnon and the time of tray setting. ENDCNTR is representative of a variable into which a number of pulses which the encoder generates upon feed of 20 papers is entered. That is, when the number of encoder pulses appearing during upward movement of the tray has increased beyond (1000-ENDCNTR), that the number of remaining papers has decreased beyond 20 is decided to stop the copying operation. At the instant of power turnon, the data memorized last time has been held in the NV-RAM 34 and, therefore, the value is not zero; if papers are present, the tray 14 is raised. However, when the tray 14 has been pulled out of the copier, the ENDCNTR is reset to zero by another subroutine and, as an immediate measure, a value "50" is entered. An ENDCNTR flag is adapted to indicate whether the value of the ENDCNTR has become definite after actually counting encoder pulses; if it is a ZERO, the value has not become definite yet.

Figure 9:
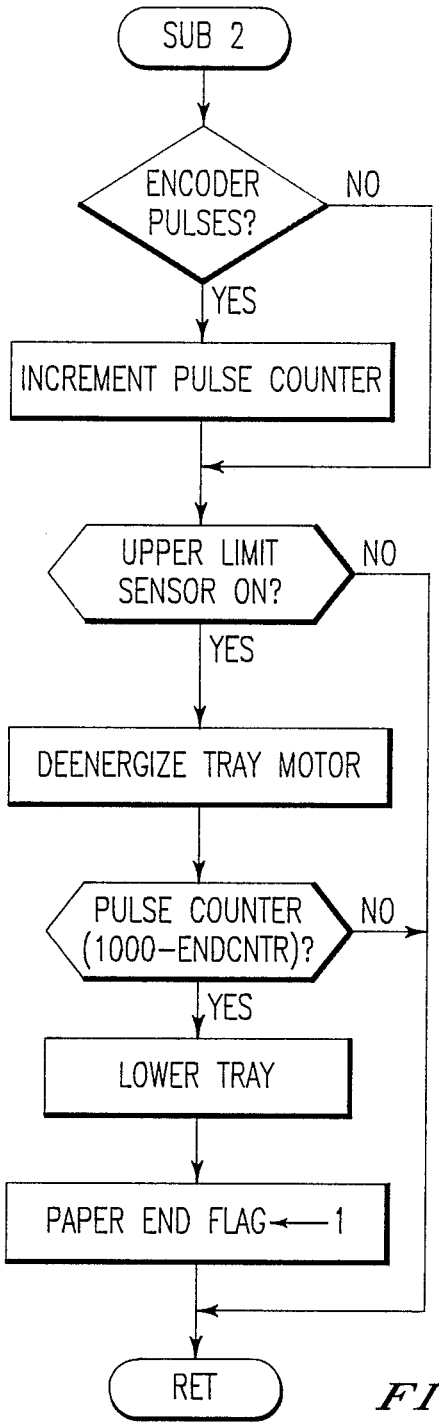
Figure 10:
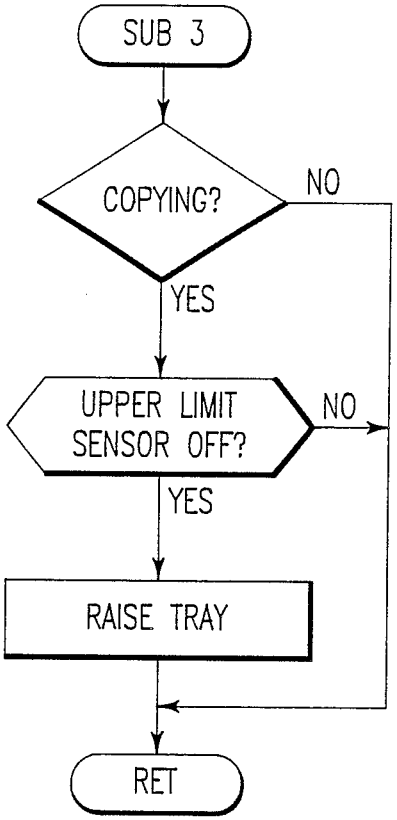

The tray 14 which has begun to rise after the SUB 1 is brought to a halt at the upper limit by SUB 2, which is shown in FIG. 9. However, if the number of encoder pulses counted then is greater than (1000-ENDCNTR), the tray 14 is lowered to wait for the supply of papers. The SUB 2 is representative of a subroutine which is constantly called up at short intervals during copying cycles as well. It is SUB 3 shown in FIG. 10 that maintains the tray 14 at the paper feed level. When called up, the SUB 3 determines whether a copying operation is under way and, if the result is "YES", delivers a raise signal to rotate the motor 12 when the upper limit sensor is off.

Figure 11:
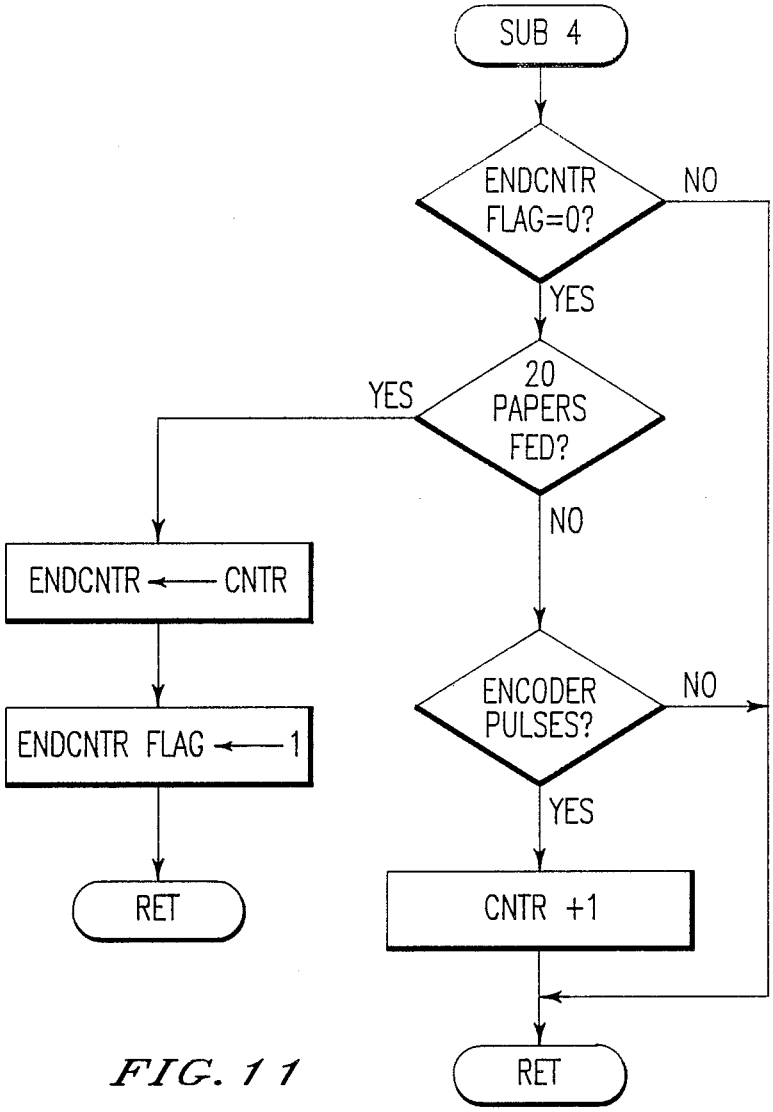

After paper feed has been actually started, how many encoder pulses appear for the feed of twenty papers is known. Hence, if the ENDCNTR is not definite yet, i.e., if ENDCNTR flag is a ZERO, it is necessary to enter the pulses generated into the ENDCNTR. A flowchart demonstrating such an operation is represented by SUB 4 in FIG. 11. Because the ENDCNTR flag is a ZERO and the ENDCNTR is not definite yet, the number of encoder pulses which appear for twenty papers is entered into CNTR. After the feed of twenty papers, the value of the CNTR is entered into the ENDCNTR. Assuming that forty pulses have appeared during the feed of twenty papers, the ENDCNTR reaches a count "40". At the same time, the ENDCNTR flag becomes a ONE to show that the ENDCNTR has become definite. Thereafter, the pulse counter is sequentially incremented as the paper feed proceeds. When the number of pulse counters has exceeded "960", i.e., when the number of remaining papers has decreased to "20", a paper end flag is made a ONE to stop the copying operation.

Figure 12:
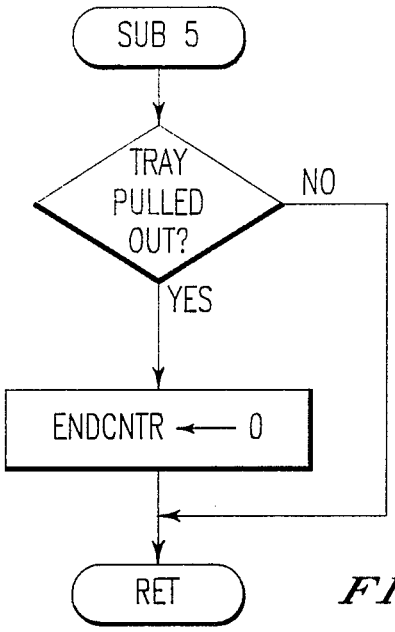
Figure 15:
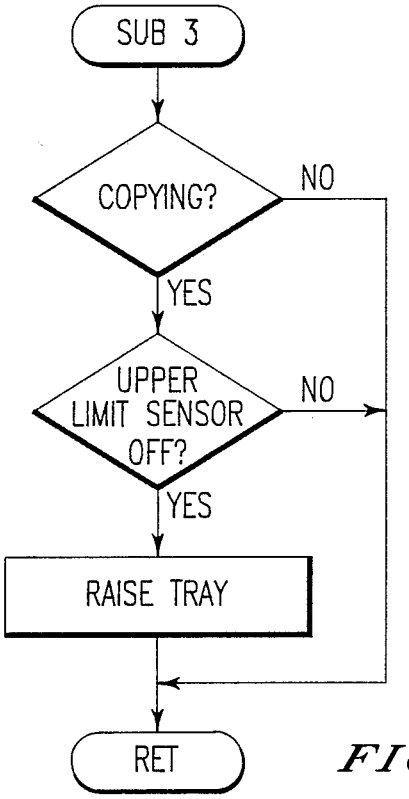
Figure 14:
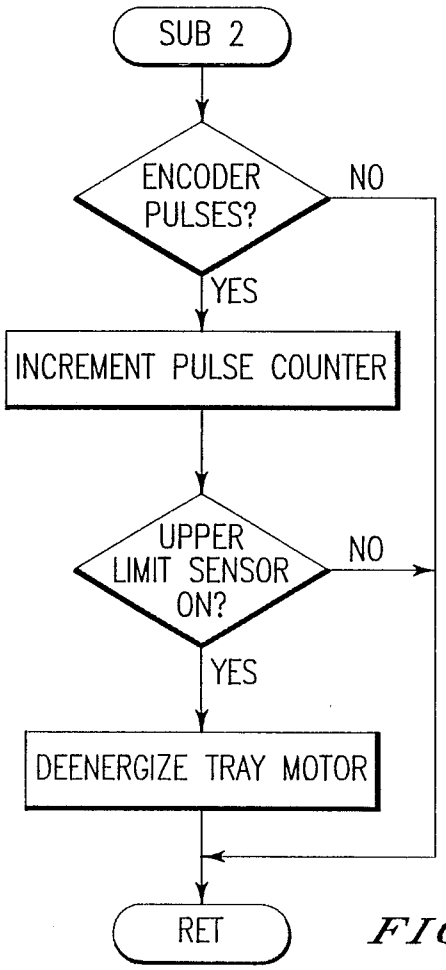
Figure 13:
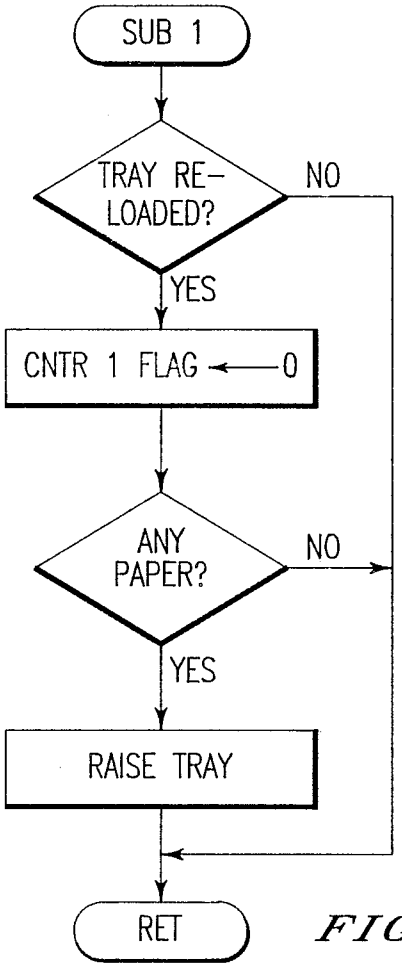
Figure 16:
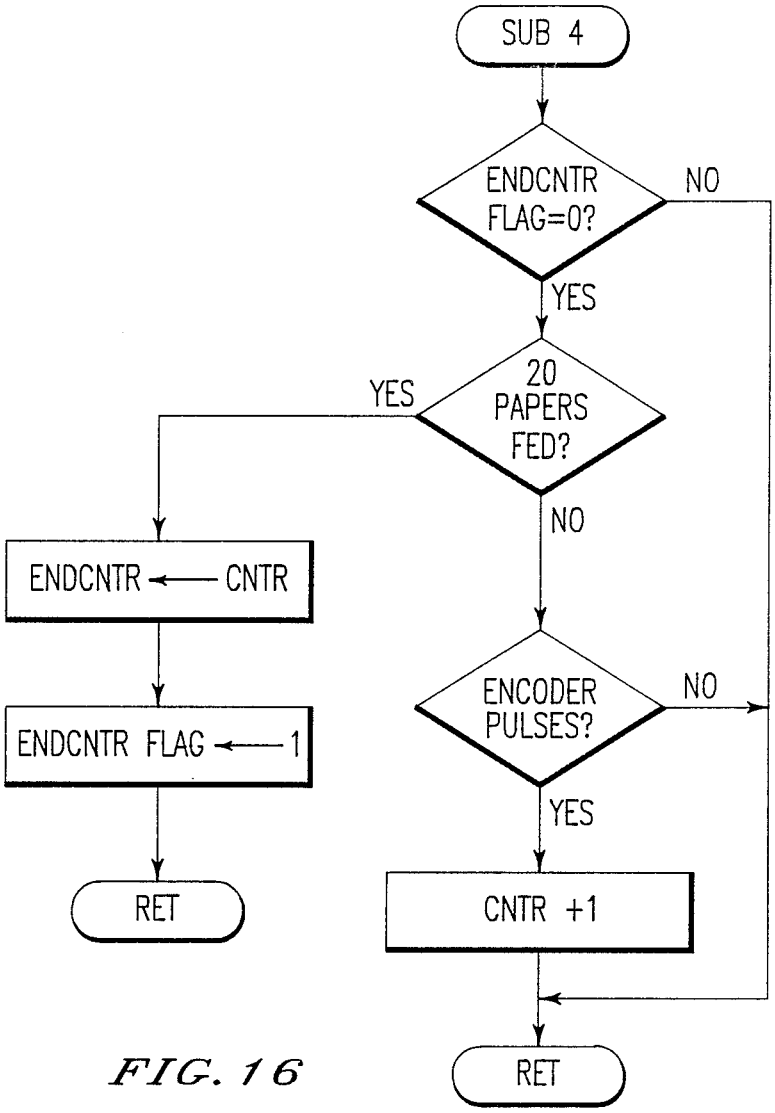
Figure 17:
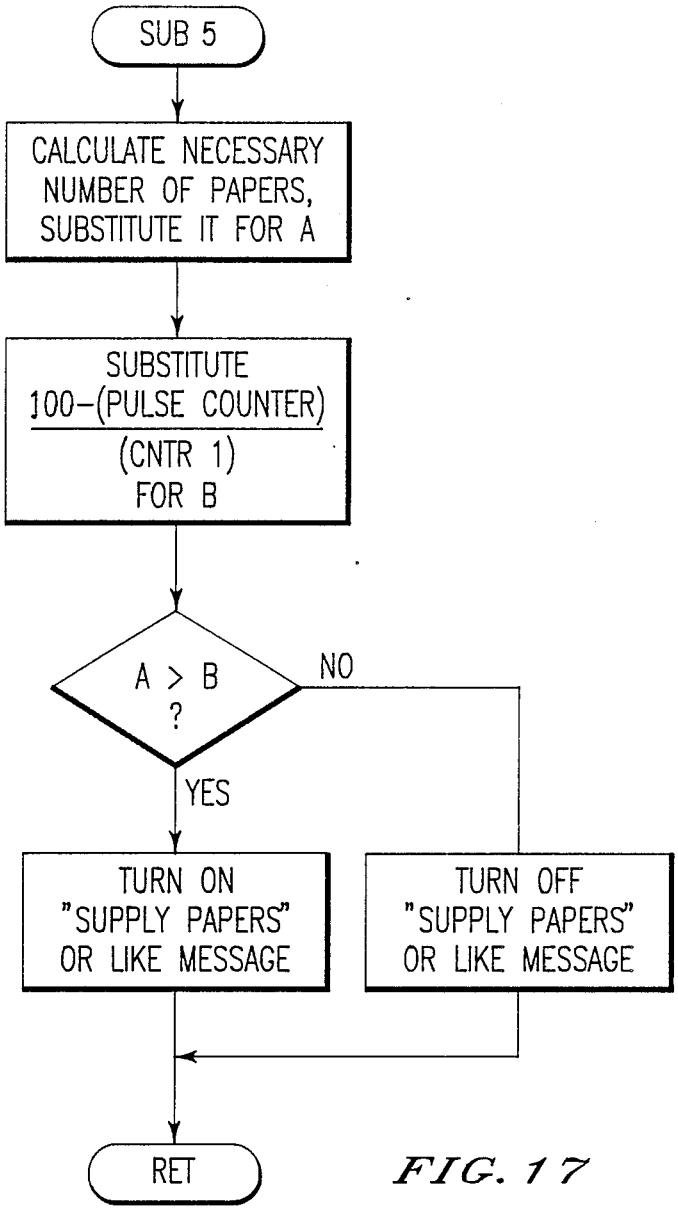

If the value of the ENDCNTR becomes definite through the above-described procedure, a paper-end condition will always be reached when the number of remaining papers is twenty with no regard to the kind of papers. Even if the power source is turned off, the data does not disappear and may be immediately used at the subsequent power turnon because the area of the ENDCNTR is reserved in the NV-RAM 34. However, once the tray 14 is pulled out of the copier, the papers in the tray 14 may possibly be replaced with another stack of papers and, therefore, the ENDCNTR value cannot be trusted. In accordance with this particular embodiment, once the tray 5 is pulled out, ENDCNTR is reset to zero as represented by SUB 5 in FIG. 12 and, then, the ENDCNTR is set again by the SUB 4.

As described above, this particular embodiment is capable of accurately sensing a near-paper-end condition with no regard to paper thickness and, therefore, allowing papers to be supplied at an adequate timing.

Various modifications will become possible for those skilled in the art after receiving the teachings of the present disclosure without departing from the scope thereof.

What is claimed is:

1. A paper feed control device for controlling a paper feed level, or height, to a predetermined one by moving up and down a tray which is loaded with a stack of papers by a motor or the like where the papers are sequentially fed, comprising:

encoder means for generating pulses responsive to an amount of movement of the tray during each of upward and downward movements of the tray;

first counter means for counting papers which are sequentially fed from the tray;

second counter means for counting the encoder pulses which correspond to papers counted by said first counter;

means for entering an initial value in said second counter means until papers are fed from the tray;

decision means for calculating a relation between a number of papers fed from the tray and the pulses generated by said encoder means; for subtracting a number determined by this relation from a number of pulses indicative of a full stack, thereby determining a number of pulses which must be generated before near-paper-end, and for comparing a number of pulses generated indicative of the paper feed level with the number indicating near-paper-end;

first non-volatile store means for storing the number of papers fed, the number of pulses generated by said encoder means and other data;

second store means storing a program for interrupting paper feed based on an output of said decision means; and means for clearing the stored number of pulses generated by said encoder means in the first non-volatile store means in response to a detection that said tray is being loaded with said paper.

* * * * *